US005348378A

United States Patent [19]

Zhang

[11] Patent Number: 5,348,378

[45] Date of Patent: Sep. 20, 1994

[54] PRESSURE BALANCED TORSION SYSTEM FOR A BACKREST AND THE LIKE

[76] Inventor: Yun H. Zhang, 52 Oak Avenue, Richmond Hill, Canada, L4C 6R7

[21] Appl. No.: 820,338

[22] Filed: Jan. 14, 1992

[30] Foreign Application Priority Data

Aug. 20, 1991 [CA] Canada ..... 2049580

[51] Int. Cl.[5] ..... A47C 7/35

[52] U.S. Cl. ..... 297/452.49; 297/452.1; 267/154

[58] Field of Search ..... 297/285, 291, 452, 452.1, 297/452.49, 452.5, 452.52, 452.54; 16/308; 267/154

[56] References Cited

U.S. PATENT DOCUMENTS 3,067,453 12/1962 Lyons ..... 267/154 X

FOREIGN PATENT DOCUMENTS 0631522 12/1927 France ..... 297/285

*Primary Examiner*—Kenneth J. Dorner
*Assistant Examiner*—Milton Nelson, Jr.
*Attorney, Agent, or Firm*—David W. Wong

[57] ABSTRACT

The pressure balanced torsion system is for use in a backrest and the like. The system has a plurality of torsion action assemblies. Each assembly consists of a pair of pressure bearing plates mounted at the free ends of a torsion spring. The torsion spring is pivotally mounted to a rigid support plate which forms the back plate of the backrest. When a body rests against the backrest, the counter reactive force generated by the assembly causes both pressure bearing plates to push back against the body until the torsion is balanced, thus providing a uniform support to the body.

9 Claims, 3 Drawing Sheets

PRESSURE BALANCED TORSION SYSTEM FOR A BACKREST AND THE LIKE

BACKGROUND OF THE INVENTION

This invention relates to a body support system and more particularly relates to a torsion system suitable for use in a backrest and the like, which is self-adjusting to a pressure balanced state to conform to the human body contour so as to provide a complete support therefor even as the body moves relative to the support.

Commonly, backrests do not provide a full support to the human body resting against it, mainly because of the irregular curvature of the back in the human body. Some back rests attempt to provide a better support to the human body by providing various protrusions at predetermined fixed locations therein so that all areas of the back of the human body are in contact with a fixed support when resting against the same. Such fixed backrests do not provide any reactive pressure to support the human body.

Another common support uses a plurality of compression and/or tension springs. In such a system, a plurality of such compression springs, such as coil springs, are mounted within a collapsible frame bounded with an outer covering material. When a person rests against such system, the coil springs at the various areas are being compressed by the human body so that the system in the backrest or mattress would conform with the contour of the human body to provide a support therefor. However, the main drawback of such system is that only the springs being compressed would exert a counter reactive force against the corresponding areas of the human body exerting the compression force thereto. The curved-in or depression areas of the human body which are not in contact with the back rest would not receive any reactive force from the backrest. Therefore, such system do not provide a uniform pressure balanced support to the human body resting against it, resulting in the muscle in the unsupported areas to tense up. The long term effect in using such backrest and mattress would result in body fatigue and the development of muscle pain.

SUMMARY OF THE INVENTION

It is a principal object of the present invention to provide a body support system which exerts a balanced counter force against the body resting against it for providing a uniform support therefor.

It is another object of the present invention to provide a body support system which reacts to the body movement to provide a constant uniform balanced support to the body.

It is another object of the present invention to provide a pressure balanced torsion system which is relatively simple in construction.

Briefly, the system according to the present invention comprises a plurality of pairs of torsion operative means mounted on a substantially rigid support plate member. Each pair of the torsion operative means including a rocker member pivotally mounted on said support plate member. A torsion spring means is coupled to the rocker member. The torsion spring means has a first free end and a second free end. A first pressure bearing plate means having a pressure receiving surface and a rear surface opposite to the pressure receiving surface. The first free end of the torsion spring means is coupled to the rear surface of the first pressure bearing plate means.

A second pressure bearing plate means having a pressure receiving surface and a rear surface opposite to the pressure receiving surface. The second free end of the torsion spring means is coupled to the rear surface of the second pressure bearing plate means. The pressure receiving surface of the first and second pressure bearing plate means are operative to provide a pressure balanced support to a human body resting against them.

Other objects of this invention will appear in the following description and appended claims, reference being made to the accompanying drawings.

BRIEF DESCRIPTION OF THE DRAWINGS

FIG. 13 is a perspective elevation view of a fifth embodiment of the torsion system having a single plate type torsion spring.

DETAILED DESCRIPTION OF THE PREFERRED EMBODIMENTS

Figure 2:
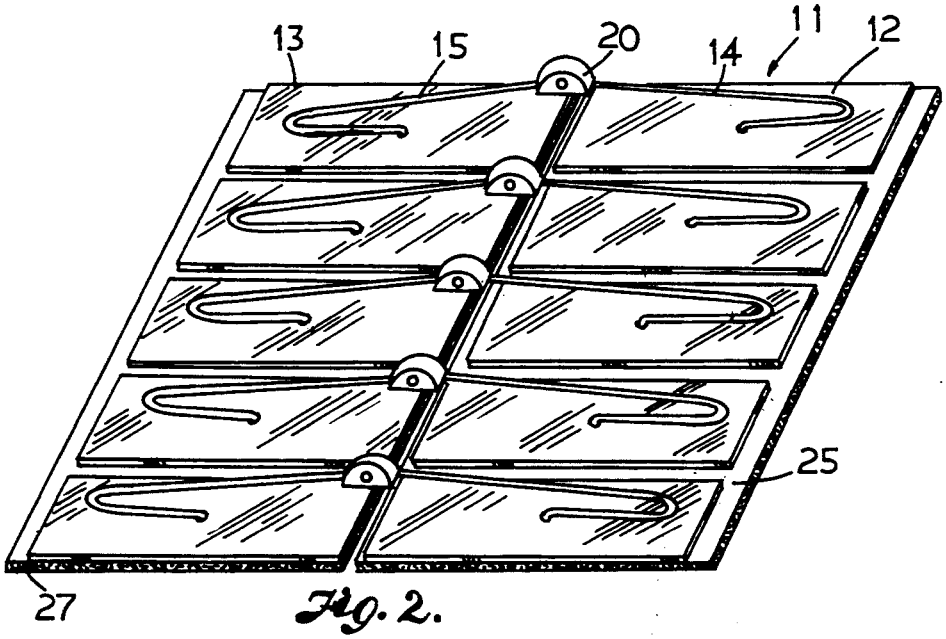
FIG. 2 is a perspective elevation view of the pressure balanced torsion system according to the present invention.
Figure 3:
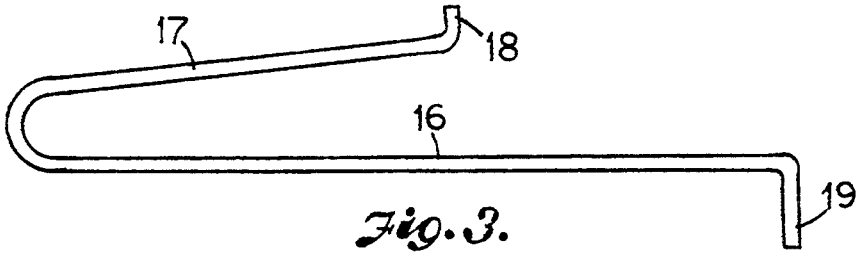
FIG. 3 is a perspective elevation view of the torsion spring means used in the torsion system according to the present invention.
Figure 6:
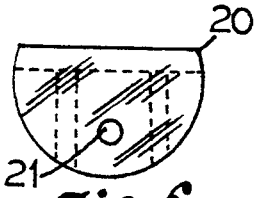
FIG. 6 is a side elevation view of the rocker member thereof.
Figure 4:
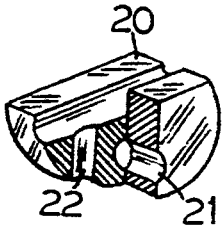
FIG. 4 is a partial cut-away perspective view of the rocker member in the torsion system according to the present invention.
Figure 5:
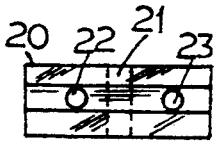
FIG. 5 is a top elevation view of the rocker member invention. thereof.
Figure 7:
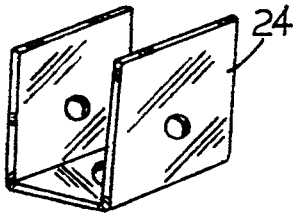
FIG. 7 is a perspective elevation view of the mounting bracket for the rocker means thereof.
Figure 9:
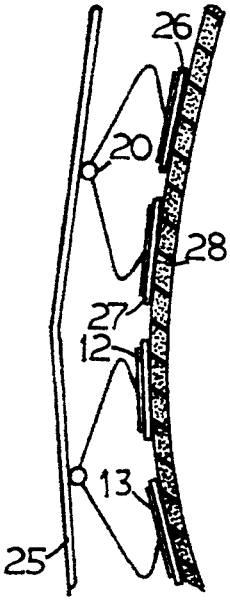
FIG. 9 is a schematic diagram showing the operation of two torsion systems in a backrest with the pressure bearing plates abutting intimately with the covering to conform with a human body contour according to the present invention.

With reference to the drawings wherein like reference numerals designate corresponding parts in the several views, a seat 10 is shown having the pressure balanced torsion system 11 according to the present invention incorporated therein. As generally shown in FIG. 2, the torsion system according to the present invention comprises a plurality of pairs of upper pressure bearing plates 12 and lower pressure bearing plates 13. These pressure bearing plates may be made of a rigid sheet material such as plastic, sheet metal, fibre board or wood board. Each pair of the pressure bearing plates 12 and 13 is coupled to a torsion spring assembly which consists of two substantially V-shaped elongated torsion springs 14 and 15. Each of these torsion springs has a longer arm 16 and a shorter arm 17 as best shown in FIG. 3. The free end of the shorter arm 17 is provided with a short right angled portion 18. The pressure bearing plate may be mounted to the right angle portion 18 of the torsion spring by the provision of a mounting hole in the rear surface of the pressure bearing plate and the right angle portion 18 is inserted into such mounting hole. The free end of the longer arm 16 is provided with a right angled end portion 19 which is mounted to a rocker member 20 as shown in FIG. 2. The rocker member 20 has a semi-circular shape as best shown in FIGS. 4, 5 and 6. A transverse through opening 21 is formed in the middle thereof, and two cross openings 22 and 23 extend perpendicular to the transverse through opening 21 from the arcuate edge to the flat edge therein for coupling with the right angled end portion of the torsion springs 14 and 15. The rocker member 20 is pivotally mounted on a U-shaped bracket 24 which, in turn, is mounted fixedly to the back plate 25. The plurality of upper pressure bearing plates 12 are secured to a flexible retaining sheet 26 such as by adhesive. The plurality of lower pressure bearing plates 13 are secured to another flexible retaining sheet 27 in the similar manner.

Figure 1:
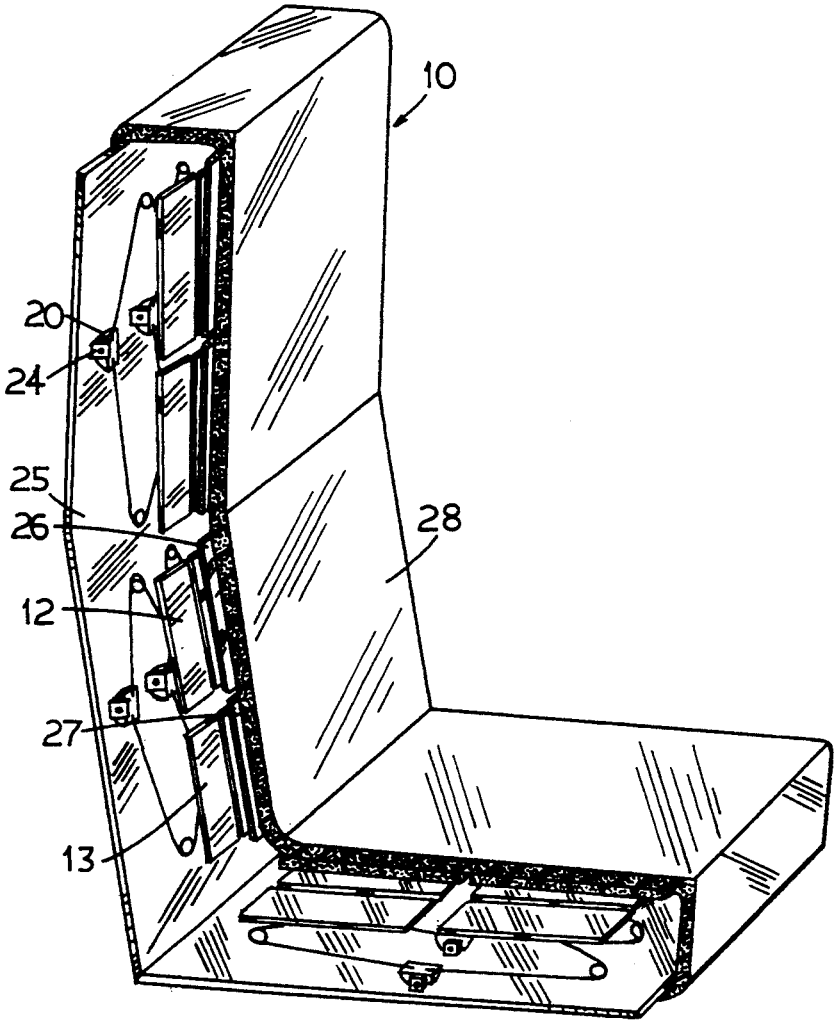
FIG. 1 is a partial cut-away perspective elevation view of a seat having a pressure balanced torsion system in its backrest and seat areas therein according to the present invention.

As generally shown in FIG. 1 the seat 10 may be provided with three such pressure balanced torsion assemblies, and the entire over all assembly is covered by an external foam-like flexible covering sheet 28.

Figure 8:
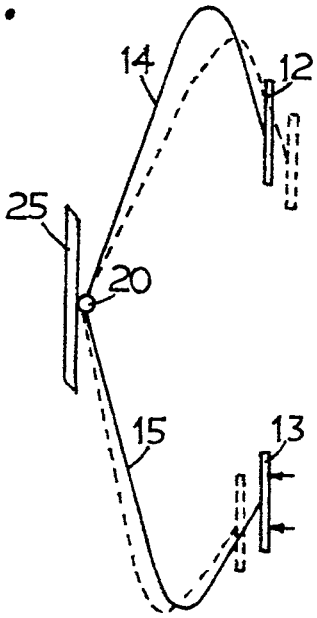
FIG. 8 is a schematic diagram showing the operation of the pressure balance torsion system according to the present invention.
Figure 10:
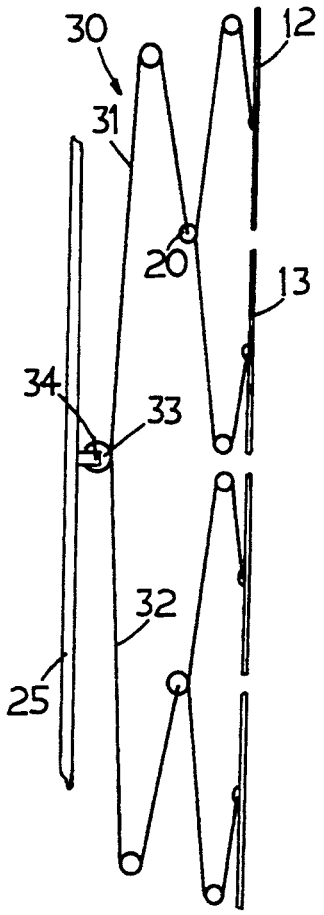
FIG. 10 shows a two-level construction of the torsion system according to the present invention.

The operation of the pressure balanced torsion system will now be described with reference to the schematic diagram shown in FIG. 8. In the normal condition, the pressure bearing plates 12 and 13 are in the positions shown by the solid lines. However, when an external pressure is applied to the lower pressure plate 13, for example, as shown by the solid arrows 29 such as applied by a human body resting against the pressure bearing plate 13, it will cause the lower pressure bearing plate 13 to move to the second position as shown by the dotted lines against the reactive torsion force of the spring 15. The distance travelled depends upon the degree of the pressure applied onto the pressure bearing plate 13. Also, it will cause the entire torsion assembly to pivot relative to the rocker member 20, as well as bending the torsion springs 14 and 15, thus resulting in pushing the upper pressure bearing plate 12 to move to the dotted line position from the solid line position. The upper pressure bearing plate 12 will then press outwards to abut the area of the human body opposite to such location, while the same location of the human body may also be exerting a pressure on the pressure bearing plate 12 against the torsion force of the spring 14. In this manner, the entire system acting and reacting to the external pressure will eventually come to a stable position in which the external force and the reactive torsion force will be balanced to each other to maintain both the upper and lower pressure bearing plates 12 and 13 pressure intimately against the human body with a seine amount of force to provide a comfortable full support therefor.

It can be appreciated by those skilled in the art that the torsion assembly will react quickly to the changing movement of the human body to maintain always a balanced reactive pressure against the entire area of the human body in contact with the system and to conform fully with the body contour.

The operation and reaction of the system may be further improved by the addition of a second level torsion assembly 30 located between the upper and lower torsion assemblies and the back plate 25. The second level torsion assembly 30 is similar in construction to the upper and lower torsion assemblies. The rocker member 20 of the upper torsion assembly is pivotally mounted to the free end of the upper torsion spring 31, and the rocker member 20 of the lower torsion assembly is pivotally mounted to the free end of the lower torsion spring 32 therein. The rocker member 33 of the second level torsion assembly is then pivotally mounted to the back plate 25 by the U-shaped bracket 34. In such construction the second level torsion assembly 30 will cooperate with the primary torsion assemblies to provide a softer but smoother reactive torsion support to the body resting against it.

Figure 14:
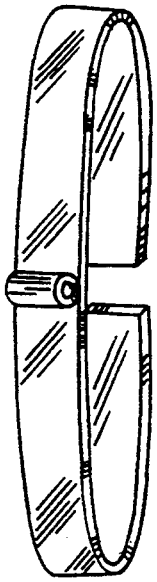
Figure 11:
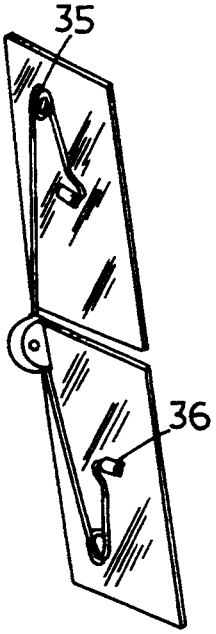
FIG. 11 is a perspective elevation view of the torsion system using a torsion spring having a second embodiment.
Figure 12:
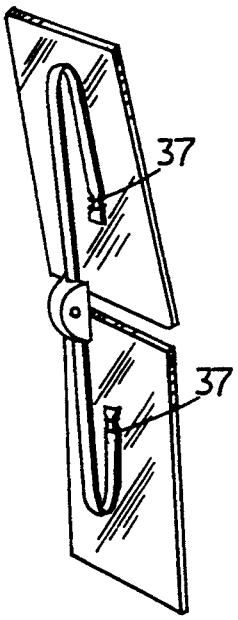
FIG. 12 is a perspective elevation view of a third embodiment having a torsion spring with a flat body.
Figure 13:
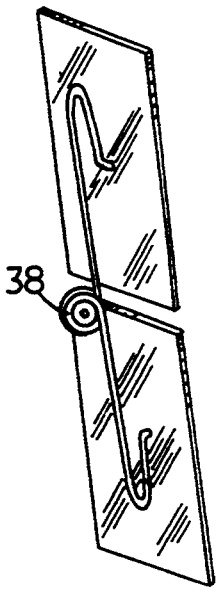
FIG. 13 a perspective elevation view of a fourth embodiment of the torsion system having a single torsion spring according to the present invention.

Obviously, numerous modifications and variations of the present invention are possible in light of the above teachings. It is therefore to be understood that within the scope of the appended claims, the invention may be practised otherwise than as specifically described above. For example, the torsion spring may have various configurations as shown in FIGS. 11, 12 and 13. As shown in FIG. 11, a coil 35 may be formed in the torsion springs 14 and 15 so as to provide a stronger reactive torsion force therein. Also, the free ends of the springs 14 and 15 may be bent 90 degrees to provide a right-angled end portion which can be expeditiously and pivotally mounted to a sleeve portion 36 provided at the rear surface of the pressure bearing plates 12 and 13. The torsion springs may be flat springs such that their free ends may be conveniently secured to the pressure bearing plates with securing clamps 37 as best shown in FIG. 12. As shown in FIG. 13, the spring may be in the form of a single torsion spring having a coil formed at it middle. The rocker member 20 may then be provided by a round disc forced fitted at the coil. Furthermore, the single torsion spring may be in the form of a substantially C-shaped plate type torsion spring as best shown in FIG. 14. In such embodiment, the pressure bearing plates may be eliminated, if the plate type torsion spring has a relatively large width, so that the free end portions of the spring can serve directly as the pressure bearing plates. Also, the rocker member may be in the form of a disc or sleeve mounted on the spring.

I claim:

1. A pressure balanced torsion system for use in a backrest and the like, comprising a first pressure bearing plate means and a second pressure bearing plate means, each of said first pressure bearing plate means and second pressure bearing plate means having a front surface and a rear surface opposite to said front surface, an elongated torsion spring means including a first arm portion having a free end mounted to said rear surface of said first pressure bearing plate means, and a second end mounted to one side of a rocker member, said torsion spring means including a second arm portion having a free end mounted to said rear surface of said second pressure bearing plate means, and a second end mounted to a second side of said rocker member, said second side of said rocker member being directly located opposite to said one side, said rocker member being pivotally mounted on a support plate.

2. A pressure balanced torsion system according to claim 1 wherein said torsion spring means has a coil configuration formed at a middle portion therein, and said rocker member is a round disc secured at said middle portion.

3. A pressure balanced torsion system according to claim 1 including a first sleeve means disposed on said rear surface of said first pressure bearing plate means, and said free end of said first arm portion of said torsion spring means being mounted to said first sleeve means, a second sleeve means disposed on said rear surface of said second pressure bearing plate means, and said free end of said second arm portion of said torsion spring means being mounted to said second sleeve means.

4. A pressure balanced torsion system according to claim 3 including a flexible retaining sheet means covering over and secured to the front surface of said first pressure bearing plate means and said second pressure bearing plate means.

5. A pressure balanced torsion system according to claim 1 including a bracket member mounted between said rocker member and said support plate, and said torsion spring means is a flat spring having two flat surfaces.

6. A pressure balanced torsion system according to claim 5 wherein said bracket member is a U-shaped bracket mounted fixedly to said support plate.

7. A pressure balanced torsion system for use in a backrest and the like, comprising a plurality of torsion balanced means located between a flexible retaining sheet means and a rigid support plate, each of said torsion balanced means including a first pressure bearing plate means and a second pressure bearing plate means, each of said first pressure bearing plate means and second pressure bearing plate means having a front surface and a rear surface located behind said front surface, an elongated torsion spring means including a first arm portion having a free end mounted to said rear surface of said first pressure bearing plate means, and a second end mounted to one side of a rocker member, said torsion spring means including a second end mounted to a second side of said rocker member, said second side of said rocker member being directly located opposite to said one side, and said rocker member being pivotally mounted on said rigid support plate.

8. A pressure balanced torsion system according to claim 7 wherein the front surfaces of said first pressure plate means and said second pressure bearing plate means are secured to said flexible retaining sheet means by adhesion.

9. A pressure balanced torsion system according to claim 8 wherein said flexible retaining sheet means is a foam sheet material, and said rigid support plate is a rigid board.

* * * * *